US012654286B2

(12) United States Patent
Hidde et al.

(10) Patent No.: US 12,654,286 B2
(45) Date of Patent: Jun. 16, 2026

(54) STAINLESS BLASTING MEDIUM

(71) Applicant: VULKAN INOX GMBH, Hattingen (DE)

(72) Inventors: Marc Hidde, Ennepetal (DE); André Hahn, Hattingen (DE)

(73) Assignee: VULKAN INOX GMBH, Hattingen (DE)

( * ) Notice: Subject to any disclaimer, the term of this patent is extended or adjusted under 35 U.S.C. 154(b) by 783 days.

(21) Appl. No.: 17/776,262

(22) PCT Filed: Nov. 19, 2020

(86) PCT No.: PCT/EP2020/082635
§ 371 (c)(1),
(2) Date: May 12, 2022

(87) PCT Pub. No.: WO2021/099445
PCT Pub. Date: May 27, 2021

(65) Prior Publication Data

US 2022/0388120 A1 Dec. 8, 2022

(30) Foreign Application Priority Data

Nov. 20, 2019 (DE) ..... 10 2019 131 297.3

(51) Int. Cl.
*B24C 11/00* (2006.01)
*C22C 38/00* (2006.01)
(Continued)

(52) U.S. Cl.
CPC ..... *B24C 11/00* (2013.01); *C22C 38/001* (2013.01); *C22C 38/02* (2013.01); *C22C 38/06* (2013.01);
(Continued)

(58) Field of Classification Search
CPC ..... B24C 11/00; C22C 38/001; C22C 38/02; C22C 38/06; C22C 38/42; C22C 38/44;
(Continued)

(56) References Cited

U.S. PATENT DOCUMENTS 5,286,310 A 2/1994 Carinci et al.
2008/0274671 A1 11/2008 O'Donoghue et al.
(Continued)

FOREIGN PATENT DOCUMENTS

CN 1453386 A 11/2003
CN 1180118 C 12/2004
(Continued)

OTHER PUBLICATIONS

SE_421430_B_Machine_Translation (Year: 1981).*
International Search Report issued Dec. 16, 2020 for PCT/EP2020/082635.

*Primary Examiner* — Anthony J Green
*Assistant Examiner* — Anastasia A. Kuvayskaya
(74) *Attorney, Agent, or Firm* — Schmeiser, Olsen & Watts LLP

(57) ABSTRACT

A stainless blasting medium is provided including blasting medium elements containing an austenitic chromium-manganese steel, the blasting medium comprising the austenitic chromium-manganese steel-containing blasting medium elements in a range of ≥90 wt.-% to ≤100 wt.-% relative to the total weight of the stainless blasting medium. The following further relates to the use of the stainless blasting medium for blasting surfaces, metal and non-metal surfaces, such as workpieces, in particular stainless workpieces.

19 Claims, 4 Drawing Sheets

Figure 1:
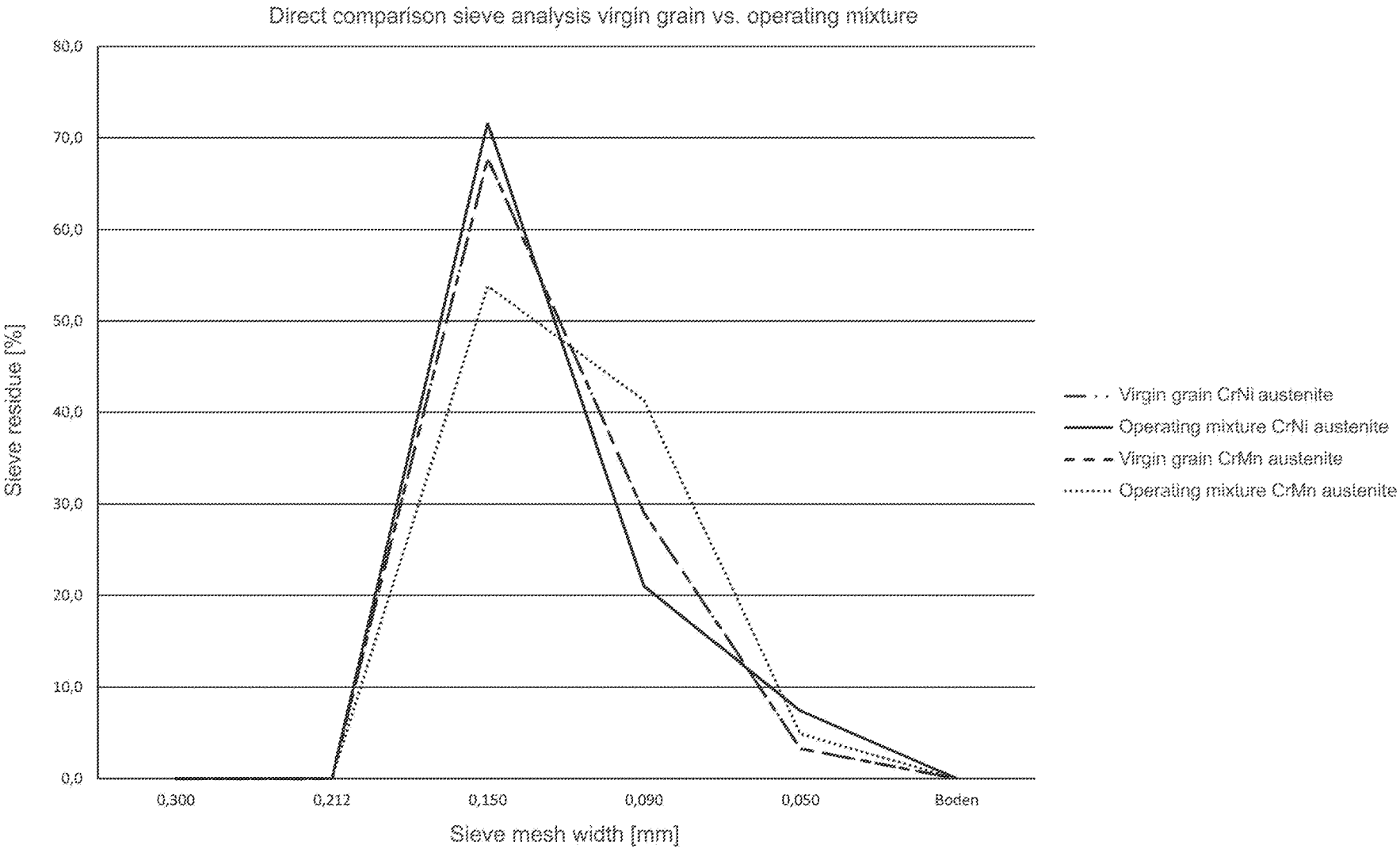

(51) Int. Cl.

| | |
|---|---|
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/58*** | (2006.01) |

(52) U.S. Cl.
CPC ..... *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/58* (2013.01)

(58) Field of Classification Search
CPC ..... C22C 38/46; C22C 38/48; C22C 38/50; C22C 38/52; C22C 38/58; C22C 38/20; C22C 38/22; C22C 38/24; C22C 38/26; C22C 38/28; C22C 38/30; C21D 2211/001
See application file for complete search history.

(56) References Cited

U.S. PATENT DOCUMENTS

| | | | | |
|---|---|---|---|---|
| 2008/0318083 | A1* | 12/2008 | Berns | C22C 38/22 428/685 |
| 2013/0130058 | A1 | 5/2013 | Iseda et al. | |
| 2014/0000330 | A1 | 1/2014 | Hatou et al. | |
| 2016/0375549 | A1* | 12/2016 | Brodalla | C25D 11/18 451/38 |

FOREIGN PATENT DOCUMENTS

| | | | | | |
|---|---|---|---|---|---|
| CN | 101035922 | A | | 9/2007 | |
| CN | 101148740 | A | | 3/2008 | |
| CN | 106319391 | A | | 1/2017 | |
| CN | 106337154 | A | | 1/2017 | |
| DE | 19723389 | A1 | | 12/1998 | |
| DE | 19815087 | A1 | | 10/1999 | |
| FR | 2246645 | A1 | | 5/1975 | |
| GB | 827297 | A | | 2/1960 | |
| JP | 5065413 | A | | 6/1975 | |
| JP | 55148701 | A | | 11/1980 | |
| JP | 2016-216802 | A | | 12/2016 | |
| RU | 2406777 | C1 | | 12/2010 | |
| SE | 421430 | B | * | 12/1981 | C22C 38/001 |
| WO | 1999051399 | A1 | | 10/1999 | |
| WO | 2018117476 | A1 | | 6/2018 | |
| WO | 2019087688 | A1 | | 5/2019 | |

* cited by examiner

STAINLESS BLASTING MEDIUM

CROSS-REFERENCE TO RELATED APPLICATIONS

This application claims priority to PCT Application No. PCT/EP2020/082635, having a filing date of Nov. 19, 2020, based on German Application No. 10 2019 131 297.3, having a filing date of Nov. 20, 2019, the entire contents both of which are hereby incorporated by reference.

FIELD OF TECHNOLOGY

The following relates to a stainless blasting medium and the use of the stainless blasting medium.

BACKGROUND

Stainless blasting mediums are known per se and are used in particular in the field of blasting treatment of workpieces. In particular, stainless blasting mediums are used in the blasting treatment of workpieces made of corrosion-resistant metals or metal alloys, since otherwise the workpieces may corrode due to residues of the blasting medium which may remain on the workpiece after the blasting treatment. Despite this problem, metallic blasting mediums are frequently used because they usually exhibit a better wear behavior compared to mineral blasting mediums, thus making them particularly suitable as reusable blasting mediums.

Stainless blasting mediums can still offer potential for improvement. In particular, there may be potential for improvement in the hardness of the blasting medium and in the wear behavior of the blasting medium.

SUMMARY

An aspect relates to an improved stainless blasting medium.

Embodiments of the invention propose a stainless blasting medium comprising blasting medium elements containing an austenitic chromium-manganese steel, wherein the blasting medium comprises the blasting medium elements containing an austenitic chromium-manganese steel in a range from ≥90 wt.-% to ≤100 wt.-%, based on the total weight of the stainless blasting medium.

In the sense of embodiments of the present invention, the term "blasting medium" means an auxiliary material which can be used in the blasting technology for surface treatment, and which can be directed at high velocity onto a workpiece or a material to be blasted.

In the sense of embodiments of the present invention, the term "stainless" means the property of being substantially inert to reactions with the environment and/or natural atmospheres. In particular, "stainless blasting mediums" are understood to mean blasting mediums that under normal conditions do substantially not react with ambient air and/or atmospheric humidity.

In the sense of embodiments of the present invention, "blasting medium elements" are understood to mean individual elements of the blasting medium such as individual grains, spheres or particles.

In the sense of embodiments of the present invention "chromium-manganese steel" is understood to mean a steel to which chromium and manganese have been added as main alloying elements. In the sense of embodiments of the present invention steel is a material composed mainly of iron.

In the sense of embodiments of the present invention, "austenitic chromium-manganese steel" is understood to mean a chromium-manganese steel which mainly has an austenitic structure.

Due to the austenitic chromium-manganese steel of the stainless blasting medium, it can be achieved that the blasting medium is particularly resistant to corrosion. In addition, it can be achieved that the blasting medium elements have a sufficiently high hardness in order to achieve particularly good results when using the blasting medium and, at the same time, a sufficient ductility so that the blasting medium has a particularly good lifetime. Without being bound by any theory, it is assumed that the austenitic chromium-manganese steel does not form deformation martensite during cold forming, as occurs when the blasting medium strikes onto the material to be blasted, which can quickly make known blasting mediums brittle and thus leads to rapid wear.

In particular, compared to known blasting mediums made of chromium-nickel steel, an improved hardness and an improved lifetime of the stainless blasting medium can be achieved. In addition, compared to blasting mediums made of chromium-nickel steel, it can be achieved that the hardness of the blasting medium increases during use due to the very good work-hardening tendency, without reducing the ductility properties.

It can be provided that the blasting medium comprises other blasting medium elements, for example metallic or mineral blasting medium elements, in addition to the blasting medium elements containing an austenitic chromium-manganese steel.

In an embodiment, it may be provided that the blasting medium comprises the blasting medium elements containing an austenitic chromium-manganese steel in a range from ≥95 wt.-% to ≤100 wt.-%, based on the total weight of the stainless blasting medium, or from ≥98 wt.-% to ≤100 wt.-%.

In an embodiment, it may be provided that the blasting medium consists of the blasting medium elements containing an austenitic chromium-manganese steel.

In an embodiment, it may be provided that the blasting medium elements containing the austenitic chromium-manganese steel consist of the austenitic chromium-manganese steel.

By means of the stainless blasting medium described above, it can be achieved that the advantageous properties of the austenitic chromium-manganese steel, in particular its hardness and wear behavior, can be particularly well utilized for the stainless blasting medium.

In an embodiment, it may be provided that the austenitic chromium-manganese steel comprises ≥10 wt.-% to ≤30 wt.-% chromium and ≥6 wt.-% to ≤30 wt.-% manganese, wherein the weight percentage is based on the total weight of the austenitic chromium-manganese steel.

In an embodiment, it may be provided that the austenitic chromium-manganese steel comprises:

≥0 wt.-% to ≤0.8 wt.-% carbon,
≥0 wt.-% to ≤1.2 wt.-% nitrogen,
≥10 wt.-% to ≤30 wt.-% chromium,
≥6 wt.-% to ≤30 wt.-% manganese,
≥0 wt.-% to ≤3 wt.-% molybdenum,
≥0 wt.-% to ≤3 wt.-% silicon,
≥0 wt.-% to ≤2 wt.-% copper,
≥0 wt.-% to ≤1 wt.-% cobalt,
≥0 wt.-% to ≤1 wt.-% nickel,
≥0 wt.-% to ≥1 wt.-% tungsten,
≥0 wt.-% to ≤1 wt.-% niobium, ≥0 wt.-% to ≤1 wt.-% vanadium,
≥0 wt.-% to ≤1 wt.-% aluminum,
≥0 wt.-% to ≤1 wt.-% titanium, and
balance iron, wherein the weight percentage is based on the total weight of the austenitic chromium-manganese steel, wherein the austenitic chromium-manganese steel comprises the carbon and the nitrogen together in an amount of ≥0.2 wt.-% to ≤1.3 wt.-%.

It should be understood that impurities occurring due to melting are included in the composition.

In an embodiment, it can be provided that the austenitic chromium-manganese steel consists of the composition described above.

By means of the above-described compositions, it can be achieved that the blasting medium has a particularly high hardness, and that the hardness of the blasting medium is further increased to a particularly high degree during use. In addition, it can be achieved that the blasting medium further exhibits a good corrosion resistance.

In an embodiment, it may be provided that the austenitic chromium-manganese steel comprises ≥15 wt.-% to ≤19 wt.-% chromium and ≥17 wt.-% to ≤21 wt.-% manganese, wherein the weight percentage is based on the total weight of the austenitic chromium-manganese steel.

In an embodiment, it may be provided that the austenitic chromium-manganese steel comprises:

≥0.1 wt.-% to ≤0.3 wt.-% carbon,
≥0.55 wt.-% to ≤0.65 wt.-% nitrogen,
≥15 wt.-% to ≤19 wt.-% chromium,
≥17 wt.-% to ≤21 wt.-% manganese,
≥0.05 wt.-% to ≤0.15 wt.-% molybdenum,
≥0.7 wt.-% to ≤1.1 wt.-% silicon,
≥0 wt.-% to ≤0.5 wt.-% copper,
≥0 wt.-% to ≤0.5 wt.-% cobalt,
≥0 wt.-% to ≤0.1 wt.-% nickel,
≥0 wt.-% to ≤0.5 wt.-% titanium,
≥20 wt.-% to ≤0.5 wt.-% vanadium,
≥0 wt.-% to ≤0.5 wt.-% niobium, and
balance iron, wherein the weight percentage is based on the total weight of the austenitic chromium-manganese steel, wherein the austenitic chromium-manganese steel comprises carbon and nitrogen together in an amount of ≥0.7 wt.-% to ≤0.9 wt.-%.

It is to be understood that impurities occurring due to melting are included in the composition.

In an embodiment, it may be provided that the austenitic chromium-manganese steel comprises:

≥0.15 wt.-% to ≤0.25 wt.-% carbon,
≥0.55 wt.-% to ≤0.60 wt.-% nitrogen,
≥16 wt.-% to ≤18 wt.-% chromium,
≥18 wt.-% to ≤20 wt.-% manganese,
≥0.05 wt.-% to ≤0.15 wt.-% molybdenum,
≥0.8 wt.-% to ≤1.0 wt.-% silicon,
≥0 wt.-% to ≤0.2 wt.-% copper,
≥0 wt.-% to ≤0.2 wt.-% cobalt.
≥0 wt.-% to ≤0.2 wt.-% nickel.
≥0% wt.-% to ≤0.2 wt.-% titanium,
≥0 wt.-% to ≥0.2 wt.-% vanadium,
≥0 wt.-% to ≤0.2 wt.-% niobium, and
balance iron, wherein the weight percentage is based on the total weight of the austenitic chromium-manganese steel, wherein the austenitic chromium-manganese steel comprises carbon and nitrogen together in an amount of ≥0.7 wt.-% to ≤0.85 wt.-%.

It is to be understood that impurities occurring due to melting are included in the composition.

In an embodiment, it may be provided that the austenitic chromium-manganese steel consists of the composition described above.

Surprisingly, it has been shown that blasting mediums comprising the composition described above exhibit a particularly long lifetime.

In an embodiment, it may be provided that the austenitic chromium-manganese steel comprises substantially no martensitic structural constituents due to the primary manufacturing process or substantially does not form martensitic structural constituents during cold working.

In an embodiment, it may be provided that the austenitic chromium-manganese steel comprises substantially no martensitic structural constituents due to the primary manufacturing process and substantially does not form martensitic structural constituents during cold working.

Thus, it can be achieved in an advantageous manner, that the blasting medium does not become softer during use. In addition, it can be achieved that the blasting medium does not quickly become brittle during use despite increasing hardness, while maintaining a constant ductility, resulting in particularly advantageous wear properties.

In an embodiment, it may be provided that the austenitic chromium-manganese steel comprises ≤5 wt.-% of martensitic structural constituents due to the primary manufacturing process and/or forms ≤5 wt.-% of martensitic structural constituents during cold working, ≤1 wt.-%, or ≤0.1 wt.-%, wherein the weight percentage is based on the total weight of the austenitic chromium-manganese steel.

In an embodiment, it can be provided that the blasting medium elements are essentially concave, elliptical, spherical.

In this way it can be achieved that the blasting medium elements are particularly homogeneously deformed during use and the wear properties are further improved.

In an embodiment, it may be provided that ≥90 wt.-%, ≥95 wt.-%, or ≥99 wt.-%, of the blasting medium elements are substantially concave, elliptical, spherical, based on the total amount of blasting medium elements.

In an embodiment, it may be provided that the blasting medium has a bulk density measured according to DIN EN ISO 60:2000-01 in a range from ≥3.5 g/cm$^3$ to ≤5 g/cm$^3$, or from ≥4.1 g/cm$^3$ to ≤4.6 g/cm$^3$.

In an embodiment, it may be provided that the blasting medium elements each have a shortest and a longest diameter, wherein the blasting medium has a proportion of blasting medium elements whose longest diameter is more than twice as large as their shortest diameter, measured according to DIN EN ISO 11125-5:2018-12, of ≤15%, or ≤5%.

In an embodiment, it can be provided that the blasting medium elements have an average equivalent diameter $D_{50}$ measured according to DIN 66165-2:2016-08 in a range from ≤3 mm to ≥0.01 mm, from ≤2.5 mm to ≥0.05 mm, or from ≤1 mm to ≥0.09 mm.

By means of the parameters described above, it can be achieved that the blasting medium can be used particularly efficiently.

In an embodiment, it can be provided that the blasting medium elements have a first average equivalent diameter $D_{50}$ as virgin grain before use and a second average equivalent diameter $D_{50}$ as an operating mixture after use, measured according to DIN 66165-2:2016-08, wherein the second average equivalent diameter is smaller than the first average equivalent diameter, at least 5% smaller, or at least 10% smaller.

In the sense of embodiments of the present invention, "virgin grain" is understood to mean the blasting medium element before it first impinges onto the material to be blasted. "Blasting medium element after a use" is understood in the sense of embodiments of the present invention to mean a mixture of blasting medium elements which has been used for treating a material to be blasted. In particular, it is to be understood to mean an operating mixture, the weight of which has been completely balanced in total at least once with virgin grain by compensating for weight loss caused by use.

In this way, it can be achieved that blasting medium elements change only slightly during use up to material fatigue.

In an embodiment, it can be provided that the blasting medium elements have a hardness as virgin grain before use, measured according to DIN EN ISO 6507-1:2018, in a range of ≥200 HV 0.1 to ≤400 HV 0.1, or ≥280 HV 0.1 to ≤360 HV 0.1.

In this way it can be achieved that the blasting medium has a sufficient hardness for a wide range of applications and, at the same time, has a sufficient ductility for particularly advantageous wear properties.

In an embodiment, it can be provided that the blasting medium elements have a first hardness as virgin grain before use and a second hardness as an operating mixture after use, measured according to DIN EN ISO 6507-1:2018, wherein the second hardness is greater than the first hardness, at least 60% greater, or at least 65% greater.

In this way, it can be achieved that an even improved hardness is set for an operating mixture.

In an embodiment, it can be provided that the blasting medium in use has a lifetime, measured at an average equivalent diameter $D_{50}$ measured according to DIN 66165-2:2016-08 in a range of ≤0.3 mm to ≥0.01 mm by means of a lifetime test according to SAE J445-Aug2013, 5.3 "100% Replacement Method A" up to an accumulated loss of 100%, of ≥25,000 cycles, ≥28,000 cycles, or ≥35,000 cycles.

In this way it can be achieved that the blasting medium is particularly efficient and is required to be replaced less frequently compared to known stainless blasting mediums.

In an embodiment, it can be provided that the blasting medium in use has an Almen intensity at the saturation point, measured at an average equivalent diameter $D_{50}$ measured according to DIN 66165-2:2016-08 in a range of ≤0.3 mm to ≥0.01 mm by means of an Almen strip N according to SAE J445-Aug2013 5.4 "Transmitted Energy Arc Height Test", of ≥0.20 mm.

In the sense of embodiments of the present invention, the saturation point is to be understood as the earliest point of a measurement curve of the arc height of an Almen strip against the blasting time at which a doubling of the blasting time causes at most a ten percent increase in the arc height.

It can be achieved that the blasting medium has an improved energy transfer when the blasting medium impinges onto the surface to be treated compared to known blasting mediums with lower Almen intensity at the saturation point. Thus, a more efficient blasting medium treatment can be achieved.

Embodiments of the invention further propose the use of a stainless blasting medium as described above, for blasting treatment of surfaces, metallic and non-metallic surfaces, such as workpieces, in particular stainless workpieces.

Further advantages and advantageous embodiments of the blasting medium according to embodiments of the invention are illustrated by the examples and figures and explained in the following description. It should be noted that the examples and figures are descriptive only and are not intended to limit embodiments of the invention in any way.

Example A

A stainless blasting medium according to embodiments of the invention comprising blasting medium elements consisting of austenitic chromium-manganese steel has been provided, comprising:

0.2 wt.-% carbon,
0.57 wt.-% nitrogen,
17 wt.-% chromium,
19.1 wt.-% manganese,
0.1 wt.-% molybdenum,
0.9 wt.-% silicon,
≤0.1 wt.-% copper,
≤0.1 wt.-% cobalt,
≤0.1 wt.-% nickel,
≤0.1 wt.-% titanium,
≤0.1 wt.-% vanadium,
≤0.1 wt.-% niobium, and
balance iron, based on the total weight of the austenitic chromium-manganese steel.

The austenitic chromium-manganese steel included essentially no martensitic structural constituents. The blasting medium elements were spherical with a content of non-spherical particles of less than 15%. The blasting medium elements had an average equivalent diameter $D_{50}$ measured according to DIN 66165-2:2016-08 in a range of ≤0.3 mm to ≥0.01 mm and a hardness measured according to DIN EN ISO 6507-1:2018, of 324±14 HV 0.1.

The lifetime was investigated by use of a Shot Testing Machine (hereinafter referred to as tester) in accordance with SAE J445 Aug2013. For this purpose, the tester was first calibrated with a calibration blasting medium. For the lifetime test, 100 g of the blasting medium according to embodiments of the invention from Example A were introduced into the tester. For the measurement, the sample was shot onto the target for 500 cycles each at a shaft speed of 7800/min and a drum speed of 25/min. After 500 cycles, the entire sample was sieved through a 50 μm sieve and the residue was weighed. From this, the loss was calculated and plotted against the number of cycles. The residue was filled up to 100 g with virgin grain of the blasting medium of embodiments of the invention from Example A and placed in the tester again. The procedure was repeated until the loss reached 100 g in total. The number of cycles required for this quantifies the lifetime of the blasting medium. For the blasting medium according to embodiments of the invention of Example A, the lifetime up to an accumulated loss of 100%, was ≥36,000 cycles.

The blasting medium obtained after the lifetime test corresponds to an operating mixture. The average equivalent diameter $D_{50}$ of the operating mixture measured according to DIN 66165-2:2016-08 remained in the range of ≤0.3 mm to ≥0.01 mm, wherein an overall broader distribution compared to the virgin grain was observed. The operating mixture had a hardness measured according to DIN EN ISO 6507-1:2018 of 575±14 HV 0.1, which was more than 65% harder than the virgin grain.

Figure 4:
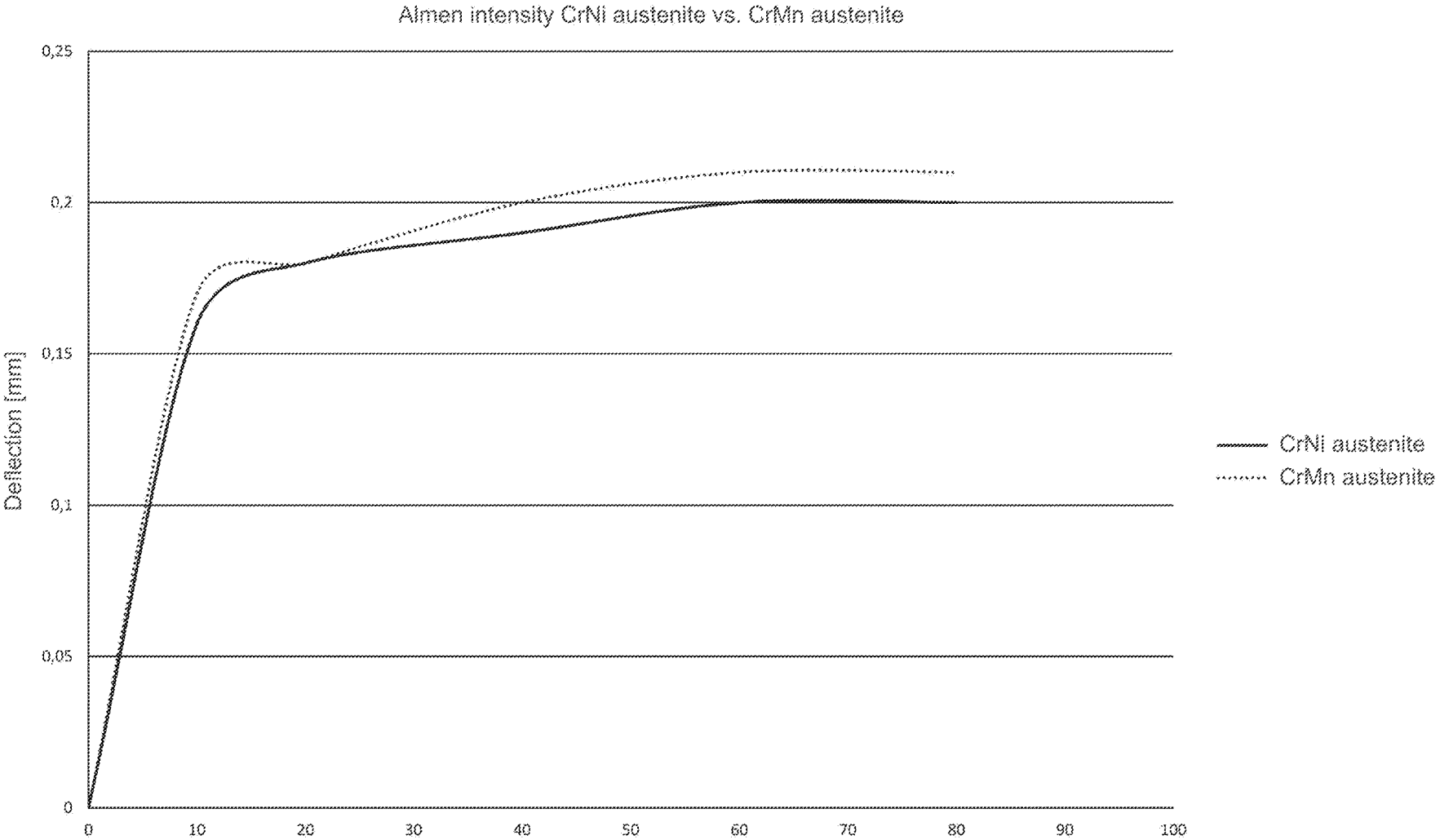

The Almen intensity at the saturation point was also examined by use of a Shot Testing Machine according to SAE J445 Aug2013. For this purpose, the sample was shot at a shaft speed of 7800/min and a drum speed of 25/min onto an Almen strip N, thickness 0.79 mm. After every 10 cycles, the arc height of the Almen strip was measured with an Almen dial gauge and plotted against the cycles (FIG. 4). An examination of the curve of the arc height showed that at 40 cycles the saturation point was reached, i.e., the earliest point at which a doubling of the blasting time (number of cycles) caused at most a ten percent increase in the arc height. Thus, an Almen intensity 0.20 mm was obtained at the saturation point for the blasting medium according to example A.

Comparative Example B

A stainless blasting medium comprising blasting medium elements consisting of chromium-nickel steel has been provided, comprising:

0.2 wt.-% carbon,
≥18 wt.-% to ≤19 wt.-% chromium,
8 wt.-% nickel,
≤2 wt.-% manganese,
≤3 wt.-% silicon, and
balance iron, based on the total weight of the chromium-nickel steel.

Compared to the blasting medium of Example A according to embodiments of the invention, the blasting medium of the Comparative Example B with a comparable equivalent diameter $D_{50}$ in a range from ≤0.3 mm to ≥0.01 mm, measured according to DIN 66165-2:2016-08 had a lower hardness, namely 301±11 HV 0.1, measured according to DIN EN ISO 6507-1:2018.

For the Comparative Example, a lifetime up to an accumulated loss of 100% of only <23,500 cycles was obtained. The average equivalent diameter $D_{50}$ of the operating mixture of Comparative Example B measured according to DIN 66165-2:2016-08 hardly changed compared to the virgin grain. Moreover, the operating mixture had a hardness measured according to DIN EN ISO 6507-1:2018 of only 512±22 HV 0.1 and was thus significantly lower than that of the blasting medium of Example A according to embodiments of the invention. In terms of the Almen intensity, an Almen intensity at the saturation point after 40 cycles of only 0.19 mm was obtained for the Comparative Example.

BRIEF DESCRIPTION

Figure 2:
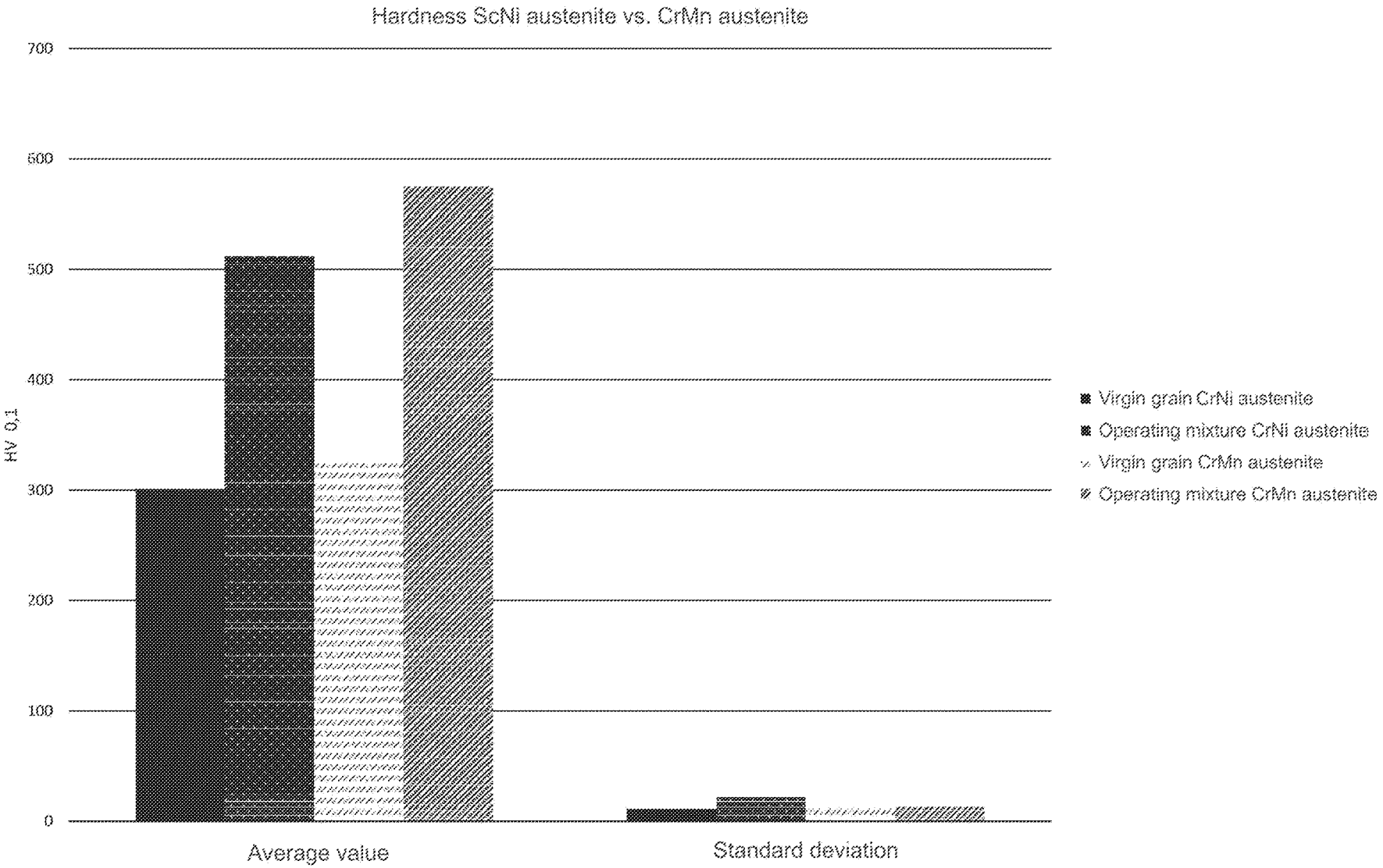
Figure 3:
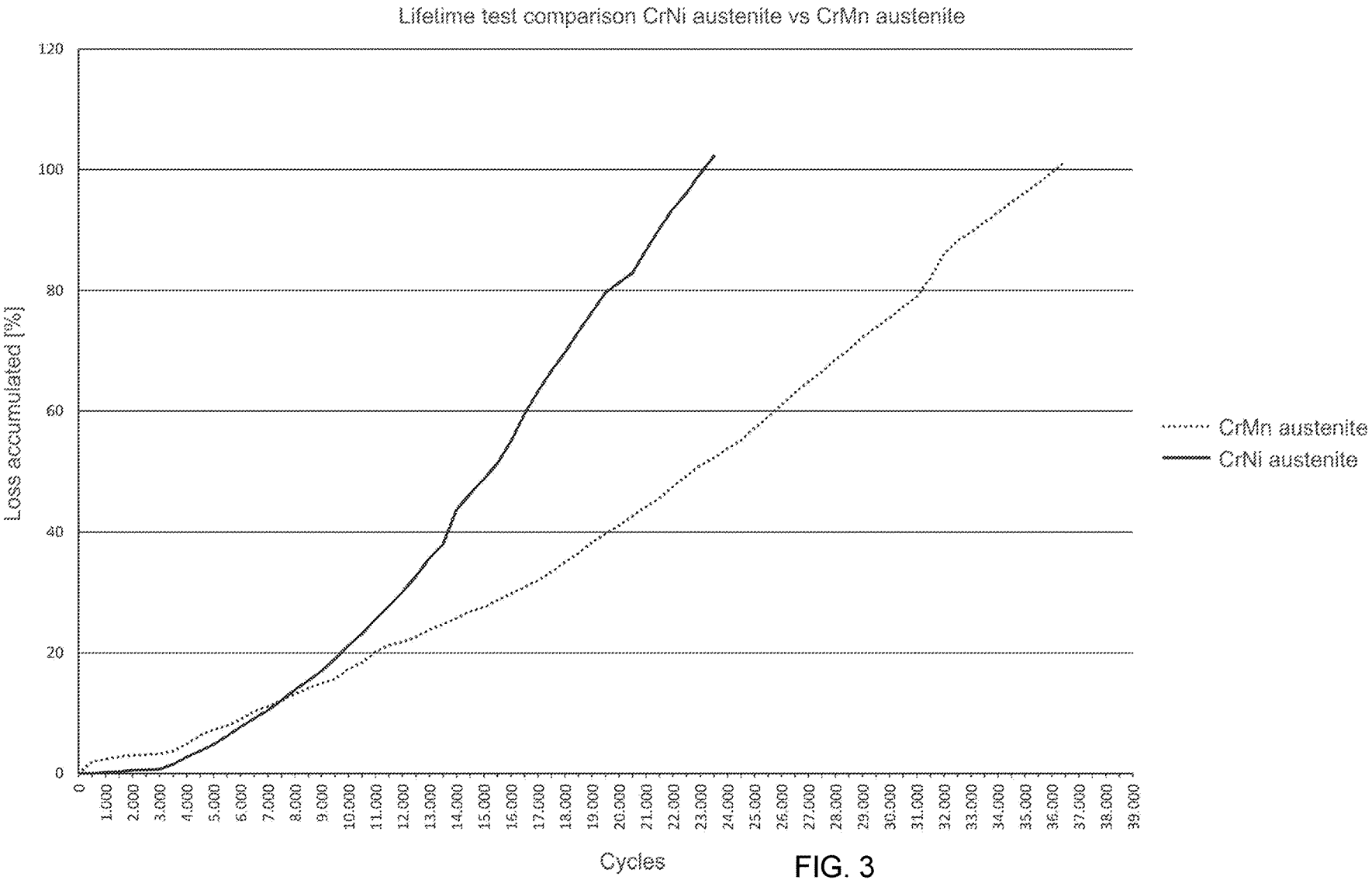

Some of the embodiments will be described in detail, with reference to the following figures, wherein like designations denote like members, wherein:

FIG. 1 is a diagram of the sieve analysis of virgin grain and operating mixture of the blasting medium according to embodiments of the invention according to Example A and the blasting medium made of chromium-nickel steel according to Comparative Example B, FIG. 2 is a diagram of the hardness analysis of virgin grain and operating mixture of the blasting medium according to embodiments of the invention according to Example A and the blasting medium made of chromium-nickel steel according to Comparative Example B;

FIG. 3 is a diagram of the lifetime test of the blasting medium according to embodiments of the invention according to Example A and the blasting medium made of chromium-nickel steel according to Comparative Example B; and FIG. 4 is a diagram of the Almen intensity of the blasting medium according to embodiments of the invention according to Example A and the blasting medium made of chromium-nickel steel according to Comparative Example B.

DETAILED DESCRIPTION

FIG. 1 shows the diagram of the sieve analysis of virgin grain and operating mixture of the blasting medium according to embodiments of the invention according to Example A (CrMn austenite) and the blasting medium made of chromium-nickel steel according to Comparative Example B (CrNi austenite). Both blasting mediums have almost identical equivalent diameters as virgin grain. Compared to the operating mixture of Comparative Example B, the operating mixture of the blasting medium according to embodiments of the invention comprises more components with a smaller equivalent diameter.

FIG. 2 shows the diagram of the hardness analysis of virgin grain and operating mixture of the blasting medium according to embodiments of the invention according to Example A and the blasting medium made of chromium-nickel steel according to Comparative Example B. Both virgin grain and operating mixture of the blasting medium according to embodiments of the invention of Example A are respectively harder than virgin grain or operating mixture of the blasting medium of Comparative Example B. In addition, the hardness increases between virgin grain and operating mixture for the blasting medium according to embodiments of the invention more than for the Comparative Example.

FIG. 3 shows the diagram of the lifetime test of the blasting medium according to embodiments of the invention according to Example A and the blasting medium made of chromium-nickel steel according to Comparative Example B. The loss plotted against the number of cycles of the blasting medium according to embodiments of the invention is much flatter compared to the loss of the Comparative Example, resulting in a longer lifetime.

FIG. 4 shows the diagram of the Almen intensity test of the blasting medium according to embodiments of the invention according to Example A and the blasting medium made of chromium-nickel steel according to Comparative Example B. After 40 cycles, both blasting mediums exhibit a saturation point at which a doubling of the number of cycles results in at most a ten percent increase in the deflection (arc height) of the Almen strip. Here, the blasting medium according to Example A exhibits an overall greater Almen intensity, from which, due to the comparability of the test conditions, a comparatively improved energy transfer during blasting can be concluded compared to Comparative Example B.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. A stainless blasting medium comprising blasting medium elements comprising an austenitic chromium-manganese steel, wherein said blasting medium comprises said blasting medium elements comprising an austenitic chromium-manganese steel in a range from ≥90 wt.-% to ≤100 wt.-%, based on the total weight of said stainless blasting medium, wherein the blasting medium in use has an Almen intensity at a saturation point, measured at an average equivalent diameter D50 measured according to DIN 66165-2:2016-08 in a range of ≤0.3 mm to ≥0.01 mm by means of an Almen strip N according to SAE J445 of ≥0.20 mm;

wherein the blasting medium has a lifetime, measured at the average equivalent diameter $D_{50}$, measured according to DIN 66165-2:2016-08, in a range from ≤0.3 mm to ≥0.01 mm by means of a lifetime test according to SAE J 445 5.3 up to an accumulated loss of 100%, of ≥25,000 cycles.

2. The stainless blasting medium according to claim 1, wherein the austenitic chromium-manganese steel comprises:

≥0 wt.-% to ≤0.8 wt.-% carbon,
≥0 wt.-% to ≤1.2 wt.-% nitrogen,
≥10 wt.-% to ≤30 wt.-% chromium,
≥6 wt.-% to ≤30 wt.-% manganese,
≥0 wt.-% to ≤3 wt.-% molybdenum,
≥0 wt.-% to ≤3 wt.-% silicon,
≥0 wt.-% to ≤2 wt.-% copper,
≥0 wt.-% to ≤1 wt.-% cobalt,
≥0 wt.-% to ≤1 wt.-% nickel,
≥0 wt.-% to ≤1 wt.-% tungsten,
≥0 wt.-% to ≤1 wt.-% niobium,
≥0 wt.-% to ≤1 wt.-% vanadium,
≥0 wt.-% to ≤1 wt.-% aluminum,
≥0 wt.-% to ≤1 wt.-% titanium, and
balance iron, wherein the weight percentage is based on the total weight of the austenitic chromium-manganese steel, and wherein the austenitic chromium-manganese steel comprises carbon and nitrogen together in an amount from ≥0.2 wt.-% to ≤1.3 wt.-%.

3. The stainless blasting medium according to claim 1, wherein the austenitic chromium-manganese steel comprises:

≥0.1 wt.-% to ≤0.3 wt.-% carbon,
≥0.55 wt.-% to ≤0.65 wt.-% nitrogen,
≥15 wt.-% to ≤19 wt.-% chromium,
≥17 wt.-% to ≤21 wt.-% manganese,
≥0.05 wt.-% to ≤0.15 wt.-% molybdenum,
≥0.7 wt.-% to ≤1.1 wt.-% silicon,
≥0 wt.-% to ≤0.5 wt.-% copper,
≥0 wt.-% to ≤0.5 wt.-% cobalt,
≥0 wt.-% to ≥0.1 wt.-% nickel,
≥0 wt.-% to ≤0.5 wt.-% titanium,
≥0 wt.-% to ≤0.5 wt.-% vanadium,
≥0 wt.-% to ≤0.5 wt.-% nobium, and
balance iron, wherein the weight percentage is based on the total weight of the austenitic chromium-manganese steel, and wherein the austenitic chromium-manganese steel comprises carbon and nitrogen together in an amount from ≥0.7 wt.-% to ≤0.9 wt.-%.

4. The stainless blasting medium according to claim 1, wherein the austenitic chromium-manganese steel comprises no martensitic structural constituents due to the primary manufacturing process or does not form martensitic structural constituents during cold working.

5. The stainless blasting medium according to claim 1, wherein the blasting medium elements are at least one of concave, elliptical, or spherical.

6. The stainless blasting medium according to claim 1, wherein the blasting medium has a bulk density measured according to DIN EN ISO 60:2000-01 in a range from ≥3.5 g/cm$^3$ to ≤5 g/cm$^3$.

7. The stainless blasting medium according to claim 1, wherein the blasting medium elements respectively have a shortest and a longest diameter, wherein the blasting medium has a proportion of blasting medium elements whose longest diameter is more than twice as large as their shortest diameter, measured according to DIN EN ISO 11125-5:2018-12, of ≤15%.

8. The stainless blasting medium according to claim 1, wherein the blasting medium elements have an average equivalent diameter $D_{50}$ measured according to DIN 66165-2:2016-08 in a range from ≤3 mm to ≥0.01 mm.

9. The stainless blasting medium according to claim 1, wherein the blasting medium elements have a first average equivalent diameter $D_{50}$ as virgin grain before use and have a second average equivalent diameter $D_{50}$ as operating mixture after use, measured according to DIN 66165-2:2016-08, wherein the second average equivalent diameter is smaller by at least 5% than the first average equivalent diameter.

10. The stainless blasting medium according to claim 1, wherein the blasting medium elements have a hardness as virgin grain before use, measured according to DIN EN ISO 6507-1:2018, in a range from ≥200 HV 0.1 to ≤400 HV 0.1.

11. The stainless blasting medium according to claim 1, wherein the blasting medium elements have a first hardness as virgin grain before use and a second hardness as operating mixture after use, measured according to DIN EN ISO 6507-1:2018-, wherein the second hardness is at least 60% greater than the first hardness.

12. The stainless blasting medium according to claim 1, wherein the blasting medium has a bulk density measured according to DIN EN ISO 60:2000-01 in a range from ≥4.1 g/cm$^3$ to ≤4.6 g/cm$^3$.

13. The stainless blasting medium according to claim 1, wherein the blasting medium elements respectively have a shortest and a longest diameter, wherein the blasting medium has a proportion of blasting medium elements whose longest diameter is more than twice as large as their shortest diameter, measured according to DIN EN ISO 11125-5:2018-12, of ≤5%.

14. The stainless blasting medium according to claim 1, wherein the blasting medium elements have an average equivalent diameter $D_{50}$ measured according to DIN 66165-2:2016-08 in a range from ≤2.5 mm to ≥0.05 mm.

15. The stainless blasting medium according to claim 1, wherein the blasting medium elements have an average equivalent diameter $D_{50}$ measured according to DIN 66165-2:2016-08 in a range from ≤1 mm to ≥0.09 mm.

16. The stainless blasting medium according to claim 1, wherein the blasting medium elements have a first average equivalent diameter $D_{50}$ as virgin grain before use and have a second average equivalent diameter $D_{50}$ as operating mixture after use, measured according to DIN 66165-2:2016-08, wherein the second average equivalent diameter is smaller by at least 10%, than the first average equivalent diameter.

17. The stainless blasting medium according to claim 1, wherein the blasting medium elements have a hardness as virgin grain before use, measured according to DIN EN ISO 6507-1:2018, in a range from ≥280 HV 0.1 to ≤360 HV 0.1.

18. The stainless blasting medium according to claim 1, wherein the blasting medium elements have a first hardness as virgin grain before use and a second hardness as operating mixture after use, measured according to DIN EN ISO 6507-1:2018-, wherein the second hardness is at least 65% greater than the first hardness.

19. The stainless blasting medium according to claim 1, wherein the lifetime of the blasting medium is ≥35,000 cycles.

* * * * *